US009238932B2

(12) United States Patent
Hori et al.

(10) Patent No.: US 9,238,932 B2
(45) Date of Patent: Jan. 19, 2016

(54) SLIDE APPARATUS FOR AUTOMOTIVE VEHICLE

(75) Inventors: Akihisa Hori, Kanagawa (JP); Hirosuke Kamae, Kanagawa (JP); Kazuhiko Tokutomi, Kanagawa (JP); Mitsuo Oka, Osaka (JP); Daisuke Mukoyama, Osaka (JP)

(73) Assignees: NISSAN MOTOR CO., LTD., Yokohama-shi (JP); KUBOKO PAINT CO., LTD., Osaka-shi ( * ) Notice: Subject to any disclaimer, the term of this patent is extended or adjusted under 35 U.S.C. 154(b) by 632 days.

(21) Appl. No.: 11/092,548

(22) Filed: Mar. 29, 2005

(65) Prior Publication Data

US 2005/0229730 A1 Oct. 20, 2005

(30) Foreign Application Priority Data

Mar. 29, 2004 (JP) ..... 2004-094352
Mar. 11, 2005 (JP) ..... 2005-069009

(51) Int. Cl.
*E05F 11/38* (2006.01)
*E05F 11/48* (2006.01)

(52) U.S. Cl.
CPC ..... *E05F 11/382* (2013.01); *E05F 11/483* (2013.01); *E05Y 2201/612* (2013.01); *E05Y 2800/108* (2013.01); *E05Y 2900/55* (2013.01); *Y10T 74/18568* (2015.01)

(58) Field of Classification Search
USPC ..... 49/348, 349, 352; 508/181
See application file for complete search history.

(56) References Cited

U.S. PATENT DOCUMENTS

| | | | | |
|---|---|---|---|---|
| 3,637,497 | A * | 1/1972 | Fitz Simmons | 508/117 |
| 4,109,417 | A * | 8/1978 | Fogarollo | 49/352 |
| 4,335,541 | A * | 6/1982 | Kazewych | 49/360 |
| 4,502,247 | A * | 3/1985 | Kobayashi et al. | 49/352 |
| 4,623,472 | A * | 11/1986 | Jamison et al. | 508/100 |
| 4,969,293 | A * | 11/1990 | Guillon | 49/441 |
| 5,307,660 | A * | 5/1994 | Stoutenburg | 72/42 |
| 5,494,596 | A * | 2/1996 | Law et al. | 508/579 |
| 6,112,462 | A * | 9/2000 | Kolar | 49/121 |
| 6,833,428 | B1 * | 12/2004 | Kato | 528/301 |
| 6,857,229 | B2 | 2/2005 | Kang | |
| 7,399,533 | B2 * | 7/2008 | Zheng et al. | 428/626 |
| 2002/0185824 | A1 * | 12/2002 | Sakane et al. | 277/628 |
| 2003/0089223 | A1 * | 5/2003 | Sugioka et al. | 92/70 |
| 2005/0235566 | A1 * | 10/2005 | Fassbender | 49/349 |
| 2006/0042167 | A1 * | 3/2006 | Dedrich et al. | 49/358 |

FOREIGN PATENT DOCUMENTS

| | | |
|---|---|---|
| DE | 41 07 129 C1 | 6/1992 |
| GB | 2 204 637 A | 11/1988 |
| JP | 7-317432 A | 12/1995 |

(Continued)

*Primary Examiner* — Gregory Strimbu
(74) *Attorney, Agent, or Firm* — Foley & Lardner LLP

(57) ABSTRACT

A slide member for use in an automotive vehicle. The slide apparatus includes a first slide member having a slidably contacting surface. Additionally, a second slide member is provided having a slidably contacting surface which is in slidable contact with the slidably contacting surface of the first slide member. In this slide apparatus, at least one of the slidably contacting surfaces of the first and second slide members is formed of a transferable water repellent material having a water repellency and a sufficient transferability to form a transferred film of the transferable water repellent material on at least the other slidably contacting surface.

6 Claims, 3 Drawing Sheets

(56) References Cited

FOREIGN PATENT DOCUMENTS

| | | | |
|---|---|---|---|
| JP | 9-112125 | A | 4/1997 |
| JP | 09-112125 | A | 4/1997 |
| JP | 9-328015 | A | 12/1997 |
| JP | 10-30643 | A | 2/1998 |
| JP | 10-37586 | A | 2/1998 |
| JP | 2002-256824 | A | 9/2002 |
| JP | 2003-312254 | A | 11/2003 |
| WO | WO 00/35705 | A1 | 6/2000 |

* cited by examiner

SLIDE APPARATUS FOR AUTOMOTIVE VEHICLE

BACKGROUND OF THE INVENTION

This invention relates to improvements in a slide apparatus for use in an automotive vehicle, more particularly, to improvements in sliding characteristics in the slide apparatus which has a slide member manually operated or electrically operated under a condition conforming to manual operation which is especially such that a bearing pressure between slidably contacting surfaces of the slide member which slidably contact with an opposite member is not higher than 60 $kg/cm^2$ and that a sliding speed is not higher than 300 mm/s. The slide member operated under the above condition includes a window regulator for a window glass operating apparatus, a guide rail of a slide door, a check link of a hinged door, a finisher of a seat belt, a cupholder, an ashtray, a hinge of a console, a hinge of a rear door, a gas-filled stay of the rear door, and the like.

There is an electrically operated window regulator for an automotive vehicle as an example of the slide apparatus. The window regulator usually includes an electric motor provided with a speed-reduction device such as a reduction gear and connected through the speed-reduction device with a drum. A wire is passed at its central portion on the drum and has opposite end portions which extend respectively through turn guides to be secured to a carrier plate. The carrier plate is a press-formed article formed of a sheet metal, and provided with a slider which is made of a plastic and slidably fitted to a guide rail. The carrier plate is fixed to a lower end side of the window glass. The guide rail is formed of pressed steel plate or sheet having a generally C-shaped cross-section. With the above arrangement, when the motor is rotationally driven, the wire passed on the drum is moved so that the carrier plate fixed to the wire is moved upward and downward together with the window glass.

In such a window regulator, a variety of devices are made to improve the sliding characteristics of the slider to the guide rail. For example, a technique is for lowering a sliding resistance by adding lubricants such as silicone oil, molybdenum disulfide or the like to a slidably contacting member of the slider in contact with the guide rail, as disclosed in Japanese Patent Provisional Publication No. 09-112125. Another technique is arranged such that a slidably contacting portion of the slider is in the shape of a roller which is in slidable contact with the guide rail, as disclosed in Japanese Patent Provisional Publication No. 2003-312254. A further technique is arranged such that the slider is provided with an elastic projecting piece which supplies lubricant to a slidably contacting surface of the guide rail while the elastic projecting piece slidably moves, as disclosed in Japanese Patent Provisional Publication No. 07-317432. A still further technique is arranged such that the slidably contacting surface of the slider in contact with the guide rail is formed with a groove to hold lubricant, as disclosed in Japanese Patent Provisional Publication No. 10-037586.

SUMMARY OF THE INVENTION

However, drawbacks have been encountered in the above conventional techniques. Specifically, in the technique of Japanese Patent Provisional Publication No. 09-112125, addition of the lubricant such as silicone oil, molybdenum disulfide or the like unavoidably softens and weakens the slider itself, so that repetition of upward and downward movement of the slider may generate a frictional wear. Thus, this technique is not always satisfactory in view of wear-resistance. In the technique of Japanese Patent Provisional Publication No. 2003-312254 using the roller-shaped slider, the number of component parts and a cost of manufacturing increase while generating foreign noise under the influence of the dimensional accuracy and the like when the roller-shaped slider rolls and slides on the guide rail. Furthermore, in the technique of Japanese Patent Provisional Publication No. 07-317432 and Japanese Patent Provisional Publication No. 10-037586 in which the slider is provided with the elastic projecting piece to supply the lubricant or has the groove to hold the lubricant such as grease, a smooth sliding condition would be degraded if a suitable amount of lubricant comes not to be held.

Therefore, it is an object of the present invention to provide an improved slide apparatus which can effectively overcome drawbacks encountered in conventional slide apparatus.

Another object of the present invention is to provide an improved slide apparatus which can be simplified in arrangement of parts, be lowered in manufacturing and material costs, and slide smoothly and stably for a long period of time.

An aspect of the present invention resides in a slide apparatus for use in an automotive vehicle, comprising a first slide member having a slidably contacting surface. Additionally, a second slide member is provided having a slidably contacting surface which is in slidable contact with the slidably contacting surface of the first slide member. In this slide apparatus, at least one of the slidably contacting surfaces of the first and second slide members is formed of a transferable water repellent material having a water repellency and a sufficient transferability to form a transferred film of the transferable water repellent material on at least the other slidably contacting surface.

Another aspect of the present invention resides in a slide apparatus for use in an automotive vehicle, comprising a first slide member having a slidably contacting surface. A second slide member is provided having a slidably contacting surface which is in slidable contact with the slidably contacting surface of the first slide member. Additionally, a coating is formed on at least one of the slidably contacting surfaces of the first and second slide members and formed of a transferable water repellent material having a water repellency and a sufficient transferability to form a transferred film of the transferable water repellent material on at least the other slidably contacting surface.

A further aspect of the present invention resides in a window regulator, comprising a guide rail having a slidably contacting surface. A slider is fixed to a window glass and slidably movable on the guide rail, the slider having a slidably contacting surface in slidable contact with the slidably contacting surface of the guide rail. Additionally, a coating is formed on at least one of the slidably contacting surface of the guide rail and the slidably contacting surface of the slider, the coating being formed of transferable water repellent material having a water repellency and a sufficient transferability to form a transferred film of the transferable water repellent material on at least the other slidably contacting surface.

DETAILED DESCRIPTION OF THE INVENTION

Figure 1:
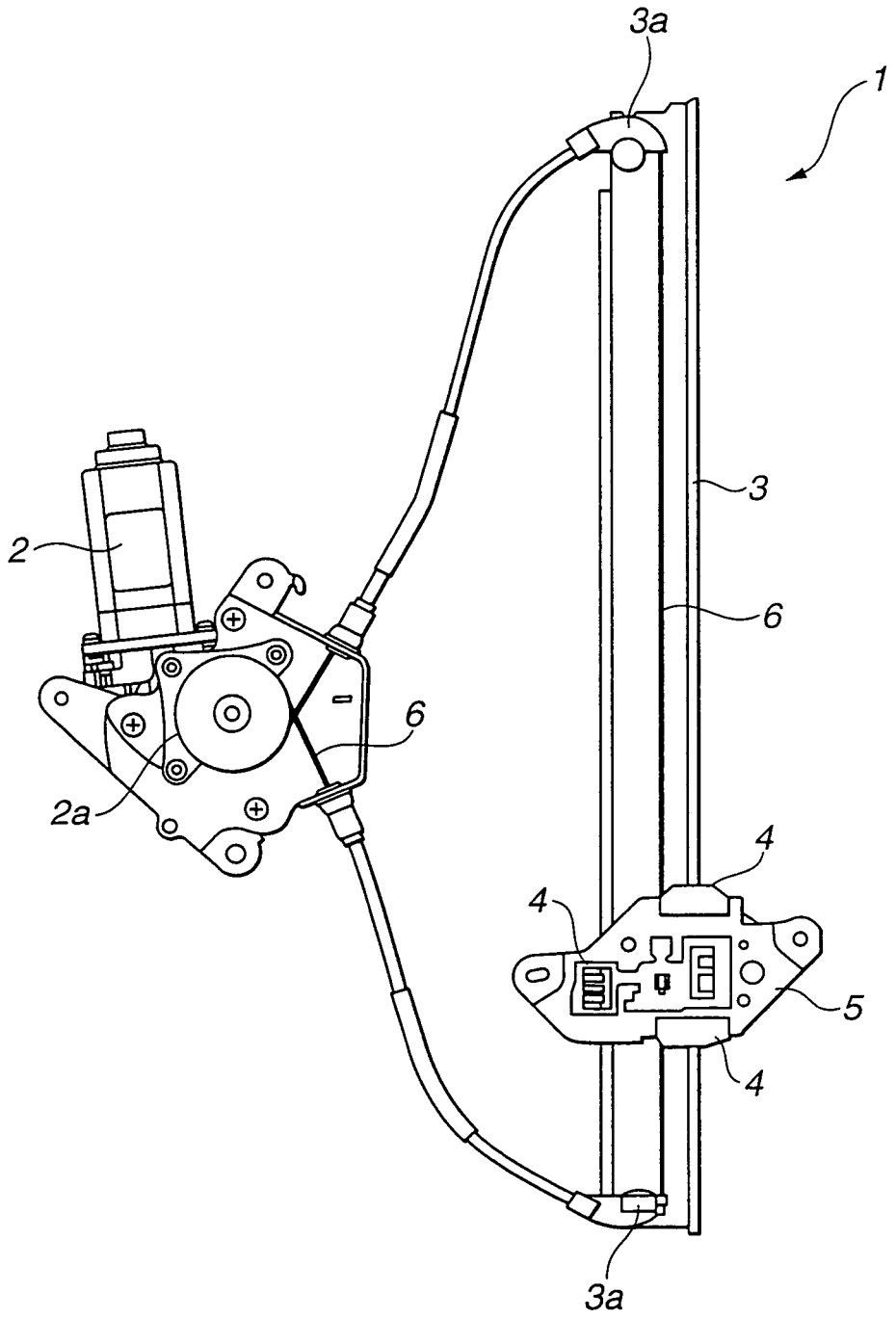
FIG. 1 is an illustration of an embodiment of an electrically operated window regulator as a slide apparatus for an automotive vehicle, which is showing a basic structure of the electrically operated window regulator.

In the slide apparatus according to the present invention, at least one of the slidably contacting surfaces of the slide members is formed of a transferable water repellent material having a sufficient transferability (an ability to be transferred to the other member to form a film on the surface of the other member) to form a transferred film (the film formed upon transfer of the water repellent material) on the slidably contacting surface, so that smooth sliding characteristics for a long period of time can be obtained. In this invention, the slide member includes not only each of members which slide and move relative to each other such as a guide rail and a slider but also a member which relatively rolls and moves on the other member, such as a wheel and a roller.

Additionally, with regard to the opposite slide member, the material of a main body of the slide member and that of the slidably contacting surface of the slide member are not particularly limited, and it is essential that at least one of the slidably contacting surfaces is formed of the above-mentioned transferable water repellent material because the transferable water repellent material is transferred to the opposite slide member due to the mutual sliding movement between the both slide members, thereby forming the transferred film of the same property as that of the transferable water repellent material. In view of this, both of the slidably contacting surfaces may be formed of the transferable water repellent material.

In the slide apparatus of the present invention, a whole or a part of the slide member including the slidably contacting surface which slidably contacts with the opposite slide member is formed of the above-mentioned transferable water repellent material or is covered with a coating formed of the transferable water repellent material having the water repellency and transferability.

Especially, the slide member having a high strength can be obtained by coating the transferable water repellent material on the slidably contacting surface which slidably contacts with the opposite slide member in case that the slidably contacting surface is of an appropriate base material such as steel. The slide member is, for example, a guide rail for a slide door, which can support a heavy member.

It is preferable that the above coating has a thickness within a range of from 10 to 100 μm. In case that the coating has a thickness smaller than 10 μm, when repetition of sliding movement is made under a condition in which the bearing pressure between the slidably contacting surfaces is high, stick-slip will sometimes be generated with foreign noise and the smooth sliding characteristics may be degraded because the coating may wear down and the foundation may be exposed when lapse of a relatively short period of time. Conversely, in case that the coating has a thickness exceeding 100 μm, drawbacks such as foaming and running of the coating material will be sometimes generated according to methods of coating, so that a smooth sliding surface of the coating will not be formed thereby degrading the sliding characteristics.

Although the above transferable water repellent material is not limited particular ones, it is preferable that the transferable water repellent material, that is, the slidably contacting surface formed of the transferable water repellent material has a surface tension of not higher than $4.7\times10^{-2}$ N/m in a standard condition having a temperature of 23° C. and a relative humidity of 50%. It is more preferable that the slidably contacting surface formed of the transferable water repellent material has a surface tension of not higher than $4.5\times10^{-2}$ N/m. Namely, in case that the slidably contacting surface formed of the transferable water repellent material has a surface tension exceeding $4.7\times10^{-2}$ N/m and that a bearing pressure between the slidably contacting surfaces is considerably high, long-term repetition of sliding movement may wear the slidably contacting surface and degrade the smooth sliding characteristics.

As discussed after, the surface tension of the slidably contacting surface can be determined by measuring and calculating a contact angle which two kinds of liquids form with the slidably contacting surface. The two kinds of liquids are water (distilled water) and methylene iodide whose surface tensions have been known.

Concerning the transferability of the transferable water repellent material, i.e., the ability to form the transferred film on the slidably contacting surface by transferring the transferable water repellent material to the slidably contacting surface, the transferred film can be sufficiently formed even if the transferability of the material is low, when the slide member is used under a high bearing pressure. In contrast, it is difficult to form the transferred film on the slidably contacting surface of the opposite member if a water repellent material having a high transferability is not used, when the slide member is used under a low bearing pressure. It will be understood that the sliding speed and bearing pressure are different according to kinds of the slide apparatus for an automotive vehicle, to which the present invention is applied.

Hence it is required to select the material having sufficient transferability to form the transferred film on the slidably contacting surface of the opposite slide member, taking account of the conditions in which the slide members are used.

The transferable water repellent material which forms the slidably contacting surface has a sufficient transferability according to a sliding condition in addition to the water repellency, so that the transferable water repellent material is transferred to the slidably contacting surface of the opposite slide member, so that the transferred film is formed thereon in the initial stage of the sliding movement.

Upon forming the transferred film, even if foreign material such as dust intrudes between the mutual slidably contacting surfaces of the both slide members, the foreign material is to be embedded in the transferred film. Thus the slidably contacting surface is protected from the foreign material so as not to be damaged and worn down excessively. As a result, the slidably contacting surface is kept in a desirable condition, preventing generation of foreign noise.

It is further preferable that the transferable water repellent material having both the water repellency and transferability includes a water repellent resin having transferability such as fluorine-contained resin or fluorocarbon resin within a range of from 3 to 50 mass % (weight %).

Examples of fluorine-contained resin include polytetrafluoroethylene (PTFE), polytrifluoroethylene, polychlorotrifluoroethylene (PCTFE), polyvinylfluoride (PVF), polyvinylidenefluoride (PVDF), tetrafluoroethylene-hexafluoropropylene copolymer (FEP), tetrafluoroethylene-perfluoroalkylvinylether copolymer (PFA), ethylene-tetrafluoroethylene copolymer (ETFE), ethylene-chlorotrifluoroethylene copolymer (ECTFE), and the like, in which they can be used singly or in combination.

Examples of the transferable water repellent resin having transferability other than fluorine-contained resin include polyethylene (PE), polyvinylchloride (PVC), polystyrene (PS), polyethylene-terephthalate, polymethylmethacrylate, poly-n-butylmethacrylate, polydimethylsiloxane, and the like, in which they also can be used singly or in combination. Further, paraffin and the like can be used also as the water repellent resin.

In case that a total content of the above transferable water repellent resin having transferability is lower than 3 mass %, when repetition of sliding movement is made under a condition in which the bearing pressure between the slidably contacting surfaces is high, sometimes stick-slip is generated with foreign noise because the coating wears down and the foundation for the coating is exposed. Conversely, in case that the total content of the above water repellent resin having transferability exceeds 50 mass %, an adherence of the coating to the foundation and a surface smoothness of the coating tend to lower because a content of thermosetting resin such as amino resin, epoxy resin, and the like added as a binder component decreases relatively. Additionally, flowability of the transferable water repellent material may be lost and the workability for the coating may be degraded according to methods of coating. This is also not preferable from the economical viewpoint because such a coating material is costly.

Additionally, it is preferable that the transferable water repellent material having the water repellency and transferability contains thermosetting resin within a range of from 20 to 97 mass % as an additional component. Thermosetting resin mainly serves as the binder component which binds the transferable water repellent resins each other. In case that a total content of such thermosetting resin is lower than 20 mass %, strength of the transferable water repellent material becomes insufficient. Therefore, repetition of sliding movement especially under a condition in which the bearing pressure between the slidably contacting surfaces exceeds 60 $kg/cm^2$ and/or the sliding speed exceeds 300 mm/s tends to promote frictional wear, thereby degrading the smooth sliding characteristics. Conversely, in case that the total content of thermosetting resin exceeds 97 mass %, there is the fear that foreign noise is generated. This corresponds to a case that a total content of the transferring water repellent resin is lower than 3 mass %.

Examples of thermosetting resin include polyester-urethane based resin, epoxy-polyester based resin, epoxy resin, acrylic resin, acrylic resin polyester based resin, polyester resin-amino resin based resin, acrylic resin-amino resin based resin, in which they can be used singly or in combination.

Regarding the transferability of the transferable water repellent material, as mentioned above, it is required to be enough to form the transferred film on the slidably contacting surface of the opposite slide member under conditions (where the individual slide members are used) which are different according to the types of the slide apparatus and include the sliding speed, the bearing pressure and the like.

In the following, discussion will be made on a method of adjusting the transferability of the transferable water repellent material so as to meet the sliding speed and the bearing pressure for the individual slide members.

In order that the transferable water repellent material is transferred to the slidably contacting surface of the opposite slide member so as to form the transferred film on the slidably contacting surface, it is required that the transferable water repellent material receives friction upon rubbing made between the slidably contacting surfaces of the slide member and the opposite slide member under certain bearing pressure and speed. Then, the transferable water repellent material wears and separates, so that worn-down pieces of the transferable water repellent material existing between the both slide members is adhered to the slidably contacting surface of the opposite slide member, and pressed and spread upon repetition of sliding movement.

Therefore, it is thought to increase the content of a transferable material (such as fluorine-contained resin or fluorocarbon resin) within the transferable water repellent material in order to improve the transferability of the transferable water repellent. With this, more worn-down pieces of the transferable water repellent material come to exist on the slidably contacting surface of the opposite slide member, so that formation of the transferred film can be promoted.

Moreover, by addition of additive such as talc having the function of increasing hardness of the surface into the transferable water repellent material, the characteristics of the material can be shifted to a side where the material is liable to wear. So that the worn-down piece is liable to separate from the surface of the transferable water repellent material, thereby improving the transferability.

Further, by improving the spreading characteristics of the transferable water repellent material upon increasing molecular weight of a resinous material contained in the transferable water repellent material, even a small amount of the worn-down pieces can be spread widely, so that a large-area transferred film can be obtained.

Furthermore, the transferability can be adjusted by regulating the shape and size of particles in the transferable water repellent material even in case that the composition of the transferable water repellent material is not changed. Specifically, the transferability can be improved by increasing the ratio of the surface area to the volume of each particle, e.g., by decreasing the particle size of each particle.

Hereinafter, a window regulator 1 as an example of the slide apparatus will be discussed with reference to FIG. 1.

Figure 2A:
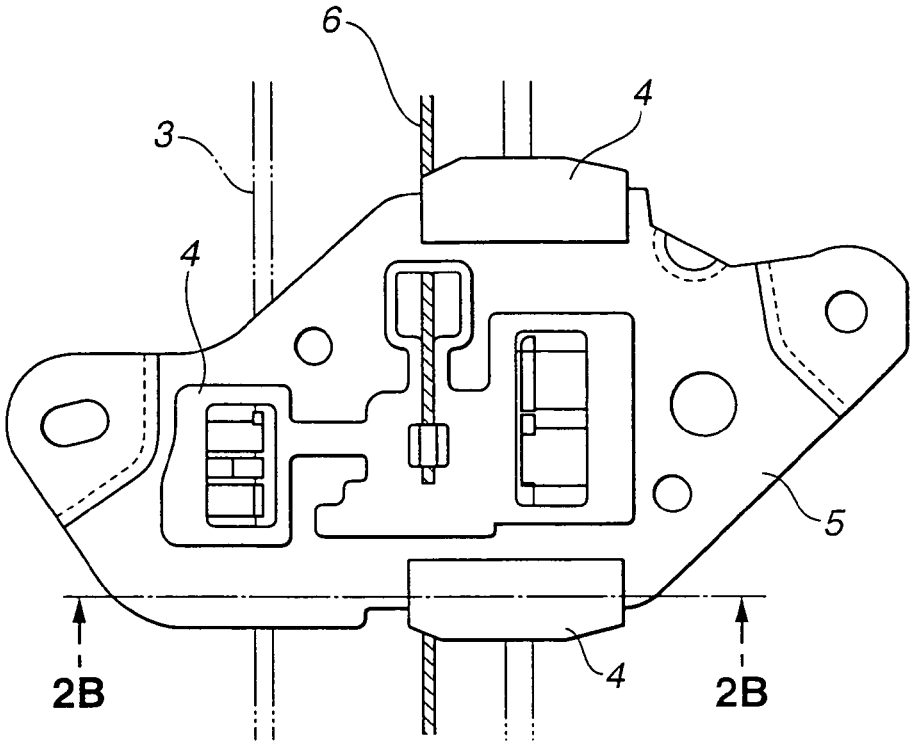
FIG. 2A is an enlarged plan view of a carrier plate of the window regulator of FIG. 1.
Figure 2B:
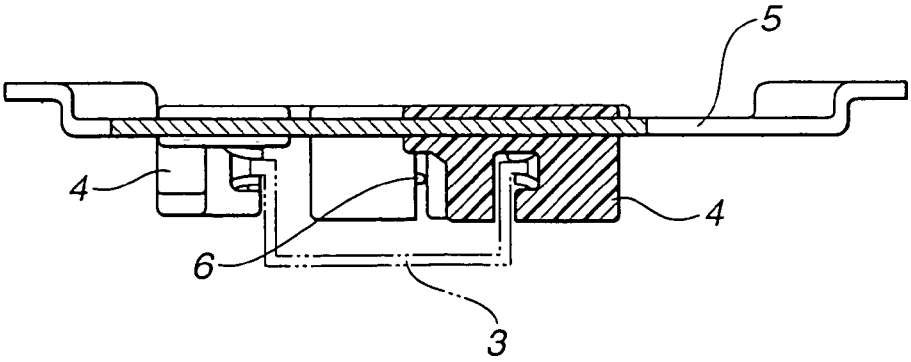
FIG. 2B is a cross-sectional view taken in the direction of arrows substantially along the line 2B-2B of FIG. 2A.

Window regulator 1 is for an automotive vehicle and electrically operated. Window regulator 1 comprises electric motor 2 which is provided with a speed-reduction device (not shown) such as a reduction gear and connected through the speed-reduction device with a drum 2*a* so as to drive drum 2*a*. Wire 6 is passed at its central portion on drum 2*a* and has opposite end portions which extend respectively through turn guides 3*a*, 3*a* to be secured to carrier plate 5. Carrier plate 5 is provided with three sliders 4 which are made of a plastic or synthetic resin and slidably fitted to guide rail 3. In concrete, carrier plate 5 is a press-formed article formed of a thin steel sheet. Three sliders 4 are made of POM (polyoxymethylene) such as polyacetal or TPEE (thermoplastic elastomer), and formed respectively at three positions of carrier plate 5 by an outsert-molding as shown in FIG. 2A and FIG. 2B. Carrier plate 5 is fixed to a lower end side of a window glass (not shown). Guide rail 5 is formed of a pressed steel plate or sheet having a generally C-shaped cross-section.

In operation, when electric motor 2 is rotationally driven, wire 6 passed on drum 2*a* is moved, so that carrier plate 5 fixed to wire 6 is moved upward of downward together with the window glass.

A coating formed of a water repellent material having a the water repellency is formed on at least one of the slidably contacting surface of guide rail 3 and the slidably contacting surface of slider 4, thereby providing smooth sliding characteristics between guide rail 3 and slider 4. In case that slider 4 outsert-molded on carrier plate 5 as shown in FIG. 1 and FIGS. 2A and 2B is formed of a resin having a certain amount of the water repellency, enough sliding characteristics can be exhibited even if the coating is formed on only the side of guide rail 3. It is a matter of course that the coating may be formed on only the side of slider 4 or on both the guide rail side and the slider side to obtain enough sliding characteristics between guide rail 3 and slider 4, depending on the components of the material of guide rail 3 and slider 4.

Although the material of the above coating is not particularly limited, it is preferable that the coating has a surface tension of not higher than $4.7\times10^{-2}$ N/m in a standard condition having a temperature of 23° C. and a relative humidity of 50%. It is more preferable that the coating has a surface tension of not higher than $4.5\times10^{-2}$ N/m. In case that the coating has a surface tension exceeding $4.7\times10^{-2}$ N/m and that a bearing pressure between the slidably contacting surface of the guide rail and the slidably contacting surface of the slider is considerably high, long-term repetition of upward and downward movement of the window glass causes the coating to wear down and therefore smooth sliding characteristics may be degraded even if at least one of the slidably contacting surface of the guide rail and the slidably contacting surface of the slider is coated with the water repellent material.

The surface tension of the coating can be determined by measuring and calculating a contact angle of the coating of two kinds of liquids such as water (distilled water) and methylene iodide whose surface tensions have been known, relative to the surface of the coating, as discussed after.

It is further preferable that the material of the above coating contains a water repellent resin such as fluorine-contained resin or fluorocarbon resin within a range of from 3 to 50 mass % (weight %) in view of securing the water repellency.

Examples of fluorine-contained resin include polytetrafluoroethylene (PTFE), polytrifluoroethylene, polychlorotrifluoroethylene (PCTFE), polyvinylfluoride (PVF), polyvinylidenefluoride (PVDF), tetrafluoroethylene-hexafluoropropylene copolymer (FEP), tetrafluoroethylene-perfluoroalkylvinylether copolymer (PFA), ethylene-tetrafluoroethylene copolymer (ETFE), ethylene-chlorotrifluoroethylene copolymer (ECTFE), and the like, in which they can be used singly or in combination.

Examples of the water repellent resin other than fluorine-contained resin include polyethylene (PE), polyvinylchloride (PVC), polystyrene (PS), polyethylene-terephthalate, polymethylmethacrylate, polyn-butylmethacrylate, polydimethylsiloxane, and the like, in which they also can be used singly or in combination. Further, paraffin and the like can be used also as the water repellent resin.

In case that a total content of the above water repellent resin is lower than 5 mass %, when repetition of upward and downward movement is made under a condition in which the bearing pressure between the slidably contacting surface of the guide rail and the slidably contacting surface of the slider is high, sometimes stick-slip is generated with foreign noise because the coating wears down and the foundation for the coating is exposed. Conversely, in case that the total content of the above water repellent resin exceeds 50 mass %, an adherence of the coating to the foundation and a surface smoothness of the coating tend to lower because a content of amino resin or epoxy resin added to the material component of the coating as a binder component relatively decreases. Additionally, flowability of the material of the coating may be lost and the workability for the coating may be degraded according to methods of coating. This is also not preferable from the economical viewpoint because such a coating material is costly.

Furthermore, it is preferable that the above coating has a thickness within a range of from 10 to 60 μm. In case that the coating has a thickness smaller than 10 μm, when repetition of upward and downward movement is made under a condition in which the bearing pressure between the slidably contacting surface of the guide rail and the slidably contacting surface of the slider is high, stick-slip will sometimes be generated with foreign noise because the coating may wear down and the foundation for the coating may be exposed when lapse of a relatively short period of time. Conversely, in case that the coating has a thickness exceeding 60 μm, drawbacks such as foaming and running of the coating material will be sometimes generated according to methods of coating, so that a smooth sliding surface of the coating will not be formed thereby degrading upward and downward movability of the window glass.

EXAMPLES

The present invention will be more readily understood with reference to the following Examples. However, these Examples are intended to illustrate the invention and are not to be construed to limit the scope of the invention.

Example 1

An acrylic resin (available from Dainippon Ink And Chemical, Incorporation under the trade name of ACRYDIC A-428) was blended with a 2:1 mixture resin of an amino resin (available from Hitachi Chemical Company, Ltd. under the trade name of MELAN 28D) and an epoxy resin (available from TOHTO KASEI CO., LTD. under the trade name of EPO-TOHTO YD-011), thereby forming a base resin serving as a binder component including thermosetting resin. Fluorine-contained resin or fluorocarbon resin (PTFE) serving as a transferable water repellent resin having transferability and titanium oxide ($TiO_2$) serving as a white pigment were blended with the base resin in such amounts that PTFE, the 2:1 mixture resin, the acrylic resin, and the white colorant became 25 mass %, 15 mass %, 25 mass % and 35 mass %, respectively, upon being baked and dried, thereby obtaining a blend resin. Further, a solvent containing xylene as a base, n-butanol, an ether-alcohol mixture-based solvent (available from Kuraray Co., Ltd. under the trade name of PGM-AC), butyl acetate and methylisobutylketon was added to and mixed with the blend resin thereby to prepare a resin mixture fluid.

Meanwhile, a plated steel sheet which have been hot-dip plated with an alloy of Zn—11 mass % Al—3 mass % Mg and having a thickness of 1.2 mm was press-formed to obtain a material of the guide rail as shown in FIG. 1 and FIGS. 2A and 2B. The resin mixture fluid was sprayed onto the whole surface of the press-formed guide rail material by using a spray gun. Thereafter, the sprayed guide rail material was baked and dried at 150° C. for 20 minutes thereby to obtain a guide rail of this Example, including a coating having a finished thickness of from 30 to 35 μm.

Example 2

A procedure of Example 1 was repeated with the exception that the blend resin was obtained by using PTFE, the 2:1 mixture resin, the acrylic resin, and the white pigment in amounts of 20 mass %, 12.5 mass %, 30 mass % and 37.5 mass %, respectively, upon being baked and dried; and the resultant guide rail included a coating having a finished thickness of from 20 to 30 μm.

Example 3

A procedure of Example 1 was repeated with the exception that the blend resin was obtained by using PTFE, the 2:1 mixture resin, the acrylic resin, and the white pigment in amounts of 10 mass %, 12.5 mass %, 35 mass % and 42.5 mass %, respectively, upon being baked and dried; and the resultant guide rail included a coating having a finished thickness of from 10 to 20 μm.

Example 4

A procedure of Example 1 was repeated with the exception that the white colorant was replaced with a precipitated barium sulfate (available from SAKAI CHEMICAL INDUSTRY CO., LTD. under the trade name of BARITE) which served as a filler; the blend resin was obtained by using PTFE, the 2:1 mixture resin, the acrylic resin, and the filler in amounts of 5 mass %, 15 mass %, 35 mass % and 45 mass %, respectively, upon being baked and dried; and the resultant guide rail included a coating having a finished thickness of from 10 to 20 μm.

Example 5

A procedure of Example 1 was repeated with the exception that the blend resin was obtained by using PTFE, the 2:1 mixture resin, the acrylic resin, and the white pigment in amounts of 5 mass %, 15 mass %, 35 mass % and 45 mass %, respectively, upon being baked and dried; and the resultant guide rail included a coating having a finished thickness of from 10 to 20 μm.

Example 6

A procedure of Example 1 was repeated with the exception that PTFE was replaced with polyethylene (PE) as the transferable water repellent resin having transferability; the blend resin was obtained by using PE, the 2:1 mixture resin, the acrylic resin, and the filler in amounts of 5 mass %, 15 mass %, 35 mass % and 45 mass %, respectively, upon being baked and dried; and the resultant guide rail included a coating having a finished thickness of from 10 to 20 μm.

Example 7

A procedure of Example 1 was repeated with the exception that PTFE was replaced with polydimethylsiloxane as the transferable water repellent resin having transferability; the blend resin was obtained by using polydimethylsiloxane, the 2:1 mixture resin, the acrylic resin, and the filler in amounts of 5 mass %, 15 mass %, 35 mass % and 45 mass %, respectively, upon being baked and dried; and the resultant guide rail included a coating having a finished thickness of from 10 to 20 μm.

Example 8

A procedure of Example 1 was repeated with the exception that the blend resin was obtained by using PTFE, the 2:1 mixture resin, the acrylic resin, and the white pigment in amounts of 5 mass %, 15 mass %, 35 mass % and 45 mass %, respectively, upon being baked and dried; and the resultant guide rail included a coating having a finished thickness of from 5 to 9 μm.

Example 9

A procedure of Example 1 was repeated with the exception that the blend resin was obtained by using PTFE, the 2:1 mixture resin, the acrylic resin, and the white pigment in amounts of 5 mass %, 32.5 mass %, 15 mass % and 47.5 mass %, respectively, upon being baked and dried; and the resultant guide rail included a coating having a finished thickness of from 10 to 20 μm.

Example 10

A procedure of Example 1 was repeated with the exception that the above acrylic resin having a glass transition point of not lower than 30° C. was replaced with an acrylic resin (available from Dainippon Ink And Chemical, Incorporation under the trade name of ACRYDIC 54-172) having a glass transition point of lower than 30° C.; the blend resin was obtained by using PTFE, the 2:1 mixture resin, the acrylic resin having a glass transition point of lower than 30° C., and the filler in amounts of 5 mass %, 17.5 mass %, 30 mass % and 47.5 mass %, respectively, upon being baked and dried; and the resultant guide rail included a coating having a finished thickness of from 10 to 20 μm.

Example 11

An epoxy resin (available from TOHTO KASEI CO., LTD. under the trade name of EPO-TOHTO YD-014, and it had a softening point of from 100 to 110° C.) and a polyester resin terminated carboxyl group (available from Japan U-PiCA Company, Ltd. under the trade name of U-Pica Coat GV-230, and it had a softening point of 121° C.) serving as a binder component including thermosetting resin; and Curezol C-11Z (available from Shikoku Chemical Corporation under the above trade name, and containing undecylimidazole), Acronal 4F (available from BASF Japan Ltd. under the above trade name, and used for a surface adjusting agent), benzoin (available from Wako Pure Chemical Industries, Ltd., and used as a foaming inhibitor), PTFE serving as the transferable water repellent resin having transferability, and pigments and/or fillers (titanium oxide and carbon black) were blended with each other at room temperature to obtain a blend resin. Thereafter, the blend resin was melted and kneaded, ground, and then classified, thereby obtaining a powder coating containing particles whose average particle size was 45 μm.

The powder coating was sprayed on the whole surface of the press-formed guide rail material by using electrostatic spray gun at −60 kilovolts charged. Thereafter, the coated guide rail was baked in an electric oven at 180° C. (material temperature) and was kept for 20 minutes, thereby to obtain a guide rail of this Example including a coating having a finished thickness of from 50 to 70 μm and containing the transferable water repellent material. The coating contained 35 mass % of epoxy resin, 37 mass % of polyester resin, 0.1 mass % of Curezol C-11Z, 0.5 mass % of Acronal 4F, 0.4 mass % of benzoin, 8 mass % of PTFE, and 20 mass % of pigments and/or fillers.

Example 12

An epoxy resin (available from Japan Epoxy Resin Co., Ltd. under the trade name of Epikote 1004, and it had a softening point of 97° C.) serving as a binder component including thermosetting resin, a hardener (dihydorazide adipate), Acronal 4F, PTFE serving as the transferable water repellent resin having transferability, and pigments and/or fillers (titanium oxide and carbon black) were blended with each other at room temperature to obtain a blend resin. Thereafter, the blend resin was melted and kneaded, ground, and then classified, thereby obtaining a powder coating containing particles whose average particle size was 45 μm.

A procedure (for coating) of Example 11 was repeated except for the powder coating component, thereby obtaining a guide rail of this Example coated with a coating containing the transferable water repellent material. The coating contained 72 mass % of the epoxy resin, 4.5 mass % of the hardener, 0.5 mass % of Acronal 4F, 8 mass % of PTFE, and 20 mass % of the pigments and/or fillers.

Example 13

A thermosetting polyester resin terminated hydroxyl group (available from Japan U-PiCA Company, Ltd. under the trade name of U-Pica Coat GV-100, and it had a softening point of 110° C.) serving as a binder component including thermosetting resin, an isocyanate compound hardener (available from Hülls under the trade name of B-1530), Acronal 4F, benzoin, PTFE serving as the transferable water repellent resin having transferability, and pigments and/or fillers (titanium oxide and carbon black) were blended with each other at room temperature to obtain a blend resin. Thereafter, the blend resin was melted and kneaded, ground, and then classified, thereby obtaining a powder coating containing particles whose average particle size was 45 μm.

A procedure (for coating) of Example 11 was repeated except for the powder coating component, thereby obtaining a guide rail of this Example coated with a coating containing the transferable water repellent material. The coating contained 62 mass % of the polyester resin, 10 mass % of the isocyanate compound hardener, 0.6 mass % of Acronal 4F, 0.4 mass % of benzoin, 8 mass % of PTFE, and 20 mass % of the pigments and/or fillers.

Comparative Example 1

Neither thermosetting resin serving as the binder component nor the transferring water repellent resin were used. A mixture colorant of aluminum silicate and carbon black was blended with a 4:1 mixture resin of an epoxy resin (available from Arakawa Chemical Industries, Ltd. under the trade name of ARAKYD 9201) and a urethane resin (available from Nippon polyurethane Industry Co., Ltd. under the trade name of CORONET 2507) in such amounts that the mixture colorant and the 4:1 mixture resin became 10 mass % and 90 mass %, respectively, upon being baked and dried, thereby obtaining a blend resin. Further, the solvent (used in Example 1) containing xylene as the base was added to the blend resin to prepare a resin mixture fluid. The resin mixture fluid was sprayed onto the whole surface of the press-formed guide rail material of Example 1 by using a spray gun. Thereafter, the sprayed guide rail material was baked and dried at 150° C. for 20 minutes to obtain a guide rail of this Comparative Example, including a coating having a finished thickness of from 10 to 20 μm.

Comparative Example 2

A guide rail material was not coated with any resinous coating and in a condition of the guide rail material of Example 1 in which the steel sheet was hot-dip plated with an alloy of Zn—11 mass % Al—3 mass % Mg and press-formed.

The compositions and thickness of the coatings of the guide rails of Examples and Comparative Examples are summarized in Table 1 in which Tg indicates the glass transition point.

Evaluation Test

Tests for evaluation of performance were conducted on the guide rail of each of Examples and Comparative Examples.

(A) Surface Tension

Figure 3:
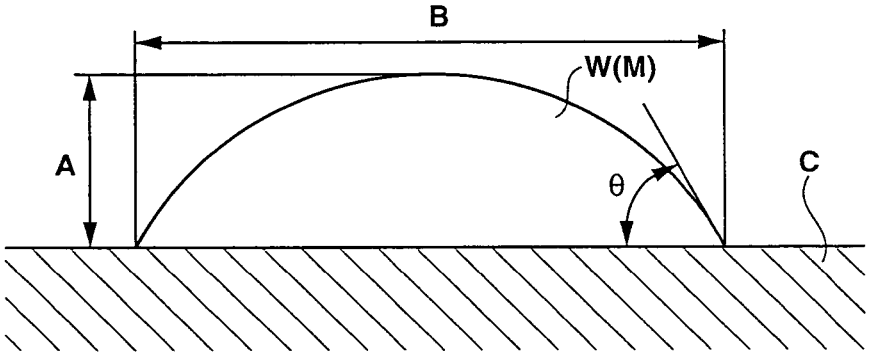
FIG. 3 is a schematic explanatory view showing a manner of measuring a contact angle of water or methylene iodide.

The guide rail obtained according to each of Examples and Comparative Examples underwent a test to obtain a surface tension of the coating. To obtain it, first, a contact angle of water for the surface of the coating was measured and calculated as follows:

In a condition having a temperature of 23° C. and a relative humidity of 50%, as shown in FIG. 3, the surface of the coating C was kept horizontal. Then, a droplet of distilled water W was dropped on the coating C in such a manner that a contact angle θ for the surface of the coating became the maximum, by using a micro-syringe. After lapse of 30 seconds from dropping of water, the droplet of water W was observed from the just lateral side to measure a distance (height) A and a distance (width) B. Then, the contact angle θ of the droplet of water was calculated by following equation (1):

$$\text{Contact angle } \theta = 2\tan^{-1}\{A/(B/2)\} \quad (1)$$

Similarly, by dropping methylene iodide, the distance A and the distance B of methylene iodide were measured to calculate the contact angle θ of methylene iodide using the equation (1).

Subsequently, the surface tension of the coating was calculated by substituting the above obtained contact angle and known characteristic values of water or methylene iodide into equation (5) derived from the Young's equation (2), an adhesion work equation (3), and an extended Fowkes' equation (4).

$$\gamma SV - \gamma SL = \gamma LV \cos\theta \quad (2)$$

$$W_A = \gamma SV + \gamma LV - \gamma SL = (\gamma S - \gamma SV) + (\gamma SV + \gamma LV - \gamma SL) \quad (3)$$

$$\gamma SL = \gamma SV + \gamma LV - 2(\gamma S^d \gamma L^d)^{1/2} - 2(\gamma S^p \gamma L^p)^{1/2} \quad (4)$$

$$\gamma LV(1+\cos\theta) = 2(\gamma S^d \gamma L^d)^{1/2} + 2(\gamma S^p \gamma L^p)^{1/2} \quad (5)$$

The Young's equation (2) is concerned with balance of forces acting on interfaces among liquid (L), solid (S) and vapor (V). The adhesion work equation (3) is concerned with an amount of adhesion work acting when liquid adheres to solid. The extended Fowkes' equation (4) is concerned with an interfacial energy which acts between a solid phase and a liquid phase. In the above equations (2) to (5), γSV is the surface tension of solid. γLV is the surface tension of liquid. γSL is the interfacial tension between solid and liquid. $W_A$ is the adhesion work. $\gamma S^d$ is the dispersion force component of the surface tension of solid, based on Van der waals force or London dispersion force of surface tension of solid. $\gamma L^d$ is the dispersion force component of the surface tension of liquid, based on Van der waals force or London dispersion force of surface tension of liquid, $\gamma S^p$ is the polarity component of the surface tension of solid, based on force between dipoles or Coulomb repulsion, and $\gamma L^p$ is the polarity component of the surface tension of liquid, based on force between dipoles or Coulomb repulsion. The known characteristic values relate to the surface tension of water, as follows:

$\gamma LV = 7.28\times10^{-2}$ (N/m);

$\gamma L^d = 2.21\times10^{-2}$ (N/m); and $\gamma L^p = 5.07\times10^{-2}$ (N/m).

On the other hand, the known characteristic values relate to the surface tension of methylene iodide, as follows:

$\gamma LV = 5.06\times10^{-2}$ (N/m);

$\gamma L^d = 4.41\times10^{-2}$ (N/m); and $\gamma L^p = 0.67\times10^{-2}$ (N/m).

Namely, a simultaneous equation having $\gamma S^d$ and $\gamma L^d$ as unknown quantities is obtained by substituting the actually measured contact angle θ and the known characteristic values of water and the actually measured contact angle θ and the known characteristic values of methylene iodide into the equation (5). Then a sum ($\gamma S^d+\gamma L^d$) of solutions of the simultaneous equation is the surface tension of solid (γSV), i.e., the surface tension of the coating of the guide rail.

The above procedure was repeated to obtain the surface tension of the coating of each guide rail of Examples and Comparative Examples.

(B) Sliding Test

Each guide rail obtained in Examples and Comparative Examples was fixed to a certain jig. Then, carrier plate 5 having slider 4 formed of TPEE resin (available from DU PONT-TORAY CO., LTD. under the trade name of Hytrel 5557) was fitted to the guide rail as shown in FIG. 2A and FIG. 2B. Wear-resistance and the sliding characteristics of each guide rail of Examples and Comparative Examples were examined after 30000 times of reciprocating motions had been made on the slider by using a tester (produced by Shinto Scientific Co., Ltd. under the trade name of HEIDEN) under a condition where the speed of each reciprocating motion was 100 mm/sec; the stroke of each reciprocating motion was 150 mm; and a load of 2 kg was applied between the guide rail and carrier plate 5 in an atmosphere at 80° C. After making 30000 times of reciprocating motions, the slidably contacting surface of the guide rail was observed with an optical microscope to confirm appearance of foundation exposure for evaluation of wear-resistance. Further, generation of stick-slip and foreign noise were confirmed for evaluation of sliding characteristics. Evaluation test results are shown as "Performance Evaluation" in Table 1 along with the compositions of the coating of each guide rail.

In Table 1, regarding the wear-resistance, "A" represents a result that no foundation was exposed; "B" represents a result that lower than 10% (in area) of the foundation was exposed; "C" represents a result that not lower than 10% (in area) of the foundation was exposed. Regarding the stick-slip of the sliding characteristics, "A" represents a result that no stick-slip was generated; "B" represents a result that stick-slip was sometimes generated; "C" represents a result that stick-slip was always generated. Regarding the foreign noise of the sliding characteristics, "A" represents a result that no foreign noise was generated; "B" represents a result that foreign noise was sometimes generated; "C" represents a result that foreign noise was always generated.

(C) Measurement of Bearing Pressure

In the sliding test, the bearing pressure applied to the slidably contacting surface of the guide rail was measured by a Tekscan Pressure Measurement System, using a sensor (MAP AND SENSOR MODEL NUMBER 5101) available from Tekscan, Inc.

(D) Confirmation of Transferred Film

Investigation was made to know as to whether the transferred film was formed or not by observing the slidably contacting surface of the carrier plate after the sliding test, using a scanning electron microscope and a EPMA (an electron probe microanalyser).

TABLE 1

| | | | Example | | | | | | | | | | | | | Compar. Example | |
|---|---|---|---|---|---|---|---|---|---|---|---|---|---|---|---|---|---|
| Sample | | | 1 | 2 | 3 | 4 | 5 | 6 | 7 | 8 | 9 | 10 | 11 | 12 | 13 | 1 | 2 |
| Composition of the coating (mass %) | Water repellent resin | PTFE | 25 | 20 | 10 | 5 | 5 | — | — | 5 | 5 | 5 | 8 | 8 | 8 | — | — |
| | | PE | — | — | — | — | — | 5 | — | — | — | — | — | — | — | — | — |
| | | Polydimethyl siloxane | — | — | — | — | — | — | 5 | — | — | — | — | — | — | — | — |
| | 2:1 (amino and epoxy resins) mixture resin | | 15 | 12.5 | 15 | 15 | 15 | 15 | 15 | 15 | 32.5 | 17.5 | — | — | — | — | — |
| | 4:1 (epoxy and urethan resins) mixture resin | | — | — | — | — | — | — | — | — | — | — | — | — | — | 90 | — |
| | Epoxy resin | | — | — | — | — | — | — | — | — | — | — | 35 | 72 | — | — | — |
| | Polyester resin | | — | — | — | — | — | — | — | — | — | — | 37 | — | 62 | — | — |
| | Acrylic resin | | 25 | 30 | 35 | 35 | 35 | 35 | 35 | 35 | 15 | 30 | — | — | — | — | — |
| | Pigment and/or Filler | | 35 | 37.5 | 42.5 | 45 | 45 | 45 | 45 | 45 | 47.5 | 47.5 | 20 | 20 | 20 | 10 | — |
| Thickness of coating (μm) | | | 31.3 | 27.1 | 18.1 | 14.8 | 12.6 | 12.8 | 13.6 | 8.2 | 15.8 | 15.3 | 55 | 60 | 55 | 15.4 | — |
| Performance Evaluation | Surface tention × $10^{-2}$ (N/m) | | 3.7 | 3.9 | 4.1 | 4.1 | 4.3 | 4.4 | 4.5 | 4.3 | 4.3 | 4.4 | 4.4 | 4.5 | 4.6 | 4.8 | 5.0 |
| | Wear—resistance (foundation exposure) | | A | A | A | A | A | A | A | B | B | B | B | B | B | C | C |
| | Sliding characteristics | Stick-slip | A | A | A | A | A | A | A | B | B | B | B | B | B | C | C |
| | | Foreign noise | A | A | A | A | A | A | A | B | B | B | B | B | B | C | C |

As apparent from Table 1, with regard to the guide rails of Examples 1 to 7 which are provided with the coating containing a proper quantity of such transferable water repellent resin having transferability as fluorine-contained resin so as to have water repellency and sufficient transferability to form the transferred film on the slidably contacting surface of the opposite slide member, no exposure was found on the foundation even after 30000 times of reciprocating motions of the slider, thereby providing such a satisfactory results that they were excellent in wear-resistance and that neither stick-slip nor foreign noise was generated. In contrast, with regard to the guide rail of Comparative Example 1 including the coating formed of the material having no the water repellency and to the guide rail of Comparative Example 2 having no coating, not lower than 10% of foundation exposure at the slidably contacting surface was confirmed, so that they were inferior in wear-resistance, and the stick-slip and foreign noise were confirmed throughout the evaluation test.

Besides, regarding Examples 8 to 13, although a slight foundation exposure was found and the stick-slip and foreign noise were sometimes generated, it was confirmed that they exhibited generally satisfactory wear-resistance and the water repellency.

Here, the reason why the sliding characteristics of the guide rail of Example 8 was slightly inferior to that of the guide rails of Example 1 to 7 is thought that the thickness of the coating was not within a preferable range.

Concerning the guide rail of Example 9, the characteristics is thought to depend on an insufficient amount of acrylic resin containing in the binder. That is, the coefficient of friction and durability (due to hardness and the like) of the binder contribute to the sliding characteristics and durability of the coating, and it can be read from the results of Examples 1 to 9 that particularly the durability of the binder depends on a content of acrylic resin. Namely, the durability of the binder comes to improvement as the content of acrylic resin increases, and therefore the durability of the coating also comes to improvement. In contrast, as the content of acrylic resin decreases, the durability of the coating tends to be degraded.

Furthermore, with respect to the guide rail of Example 10, the characteristics depends on the fact that acrylic resin (monomer) having a glass transition point of lower than 30° C., was used. In case that acrylic resin having a glass transition point of lower than 30° C. is used for the binder, the binder is liable to soften as compared with a case that acrylic resin having a glass transition point of not lower than 30° C. is used. Therefore, the coating is also liable to soften and lowered in durability. Due to this, the guide rail of Example 10 seems to be inferior to the guide rails of Example 1 to 7 in performance.

Moreover, with respect to Examples 11 to 13, the binder resins were epoxy-polyester based resin, epoxy resin, and polyester resin, respectively. Therefore, sliding characteristics and the durability of the coatings of the guide rails of Examples 11 to 13 seems to be slightly different from those of Examples 1 to 7 whose binder contained acrylic resin.

Besides, the bearing pressures applied to the slidably contacting surfaces of the guide rails were within a range of from 0 to 37.5 kg/cm$^2$. Additionally, the presence of elements such as fluorine, silicon, and magnesium was confirmed on the slidably contacting surface of the carrier plate used for the opposite slide member with which the guide rail of Examples 1 to 13 of the present invention was slidably contacted. It was also confirmed that the transferred film was formed on the slidably contacting surface of the carrier plate, having a thickness ranging about from 15 to 38 μm.

According to the present invention, at least one of the slidably contacting surfaces of the slide members of the slide apparatus is formed of the transferable water repellent material having the water repellency and transferability. This can prevent water impeding smooth sliding movement from adhering to the slidably contacting surface. Additionally, the transferred film is formed on the slidably contacting surface of the opposite slide member, and this can prevent foreign materials other than water from adhering to the slidably contacting surface or from being between the slidably contacting surfaces. Consequently, the slide apparatus having the slide member protecting the slidably contacting surface and keeping smooth sliding movement for a long period of time can be provided.

The entire contents of Japanese Patent Applications P2004-094352 (filed Mar. 29, 2004) and P2005-069009 (filed Mar. 11, 2005) are incorporated herein by reference.

Although the invention has been described above by reference to certain embodiments and examples of the invention, the invention is not limited to the embodiments and examples described above. Modifications and variations of the embodiments and examples described above will occur to those skilled in the art, in light of the above teachings. The scope of the invention is defined with reference to the following claims.

What is claimed is:

1. A slide apparatus for use in an automotive vehicle, comprising:

a first slide member having a slidably contacting surface;

a second slide member having a slidably contacting surface which is in slidable contact with the slidably contacting surface of the first slide member, the second slide member being formed of a resin; and a coating formed on the slidably contacting surface of the first slide member and formed of a transferable water repellent material having a water repellency and a sufficient transferability to form a transferred film of the transferable water repellent material on the slidably contacting surface of the second slide member;

wherein the transferable water repellent material contains 5-25 mass % of polytetrafluoroethylene, 12.5-32.5 mass % of a mixture of an amino resin and an epoxy resin, and 15-35 mass % of an acrylic resin.

2. A slide apparatus for use in an automotive vehicle as claimed in claim 1, wherein the coating has a thickness within a range of from 10 to 100 μm.

3. A slide apparatus for use in an automotive vehicle as claimed in claim 1, wherein the resin of the second slide member is a thermoplastic elastomer.

4. A window regulator comprising:

a guide rail having a slidably contacting surface;

a slider fixed to a window glass and slidably movable on the guide rail, the slider being formed of a resin and having a slidably contacting surface in slidable contact with the slidably contacting surface of the guide rail; and a coating formed on the slidably contacting surface of the guide rail, the coating being formed of a transferable water repellent material having a water repellency and a sufficient transferability to form a transferred film of the transferable water repellent material on the slidably contacting surface of the slider;

wherein the transferable water repellent material contains 5-25 mass % of polytetrafluoroethylene, 12.5-32.5 mass % of a mixture of an amino resin and an epoxy resin, and 15-35 mass % of an acrylic resin.

5. A window regulator as claimed in claim 4, wherein the resin of the slider is a thermoplastic elastomer.

6. A window regulator as claimed in claim 4, wherein the coating has a thickness within a range of from 10 to 100 μm.

* * * * *